US006062058A

United States Patent [19]

Buchegger

[11] Patent Number: 6,062,058

[45] Date of Patent: May 16, 2000

[54] ROLL STAND

[75] Inventor: Rudolf Buchegger, St.Florian, Austria

[73] Assignee: Voest-Alpine Industrieanlagenbau GmbH, Linz, Austria

[21] Appl. No.: 08/945,478

[22] PCT Filed: Apr. 23, 1996

[86] PCT No.: PCT/AT96/00078

§ 371 Date: Oct. 24, 1997

§ 102(e) Date: Oct. 24, 1997

[87] PCT Pub. No.: WO96/33823

PCT Pub. Date: Oct. 31, 1996

[30] Foreign Application Priority Data

Apr. 25, 1995 [AT] Austria ..... 711/95

[51] Int. Cl.[7] ..... B21B 31/07; B21B 35/00

[52] U.S. Cl. ..... 72/249

[58] Field of Search ..... 72/237, 238, 239, 72/249, 247, 245

[56] References Cited

U.S. PATENT DOCUMENTS 2,313,230 3/1943 Falk .
3,981,171 9/1976 Kmelisch ..... 72/249

FOREIGN PATENT DOCUMENTS 957 024 1/1957 Germany .
1 077 170 3/1960 Germany .
1 527 760 11/1970 Germany .
19 46 162 3/1971 Germany .
2 033 865 1/1972 Germany .
2 355 433 6/1974 Germany .
26 36 752 4/1977 Germany .
60-37205 2/1985 Japan .
61-193711 8/1986 Japan .
286163 3/1928 United Kingdom .

*Primary Examiner*—Rodney Butler
*Attorney, Agent, or Firm*—Hill & Simpson

[57] ABSTRACT

A roll stand with two rolls forming a gap has each roll connected to a separate drive motor by a drive train having a spindle with a toothed coupling to the drive roll. One of the drive trains includes two components connected to each other by a flexible coupling permitting a large angular shaft displacement with one of the components connected by a second flexible coupling to the drive motor and the other drive train includes the drive spindle being formed by a single component coupled to the drive shaft of the motor by a toothed coupling.

13 Claims, 2 Drawing Sheets

ROLL STAND

BACKGROUND OF THE INVENTION

The invention relates to a roll stand comprising two rolls forming a roll gap, which can be driven by their separate driving motors via drive spindles, in particular to a four-high stand, wherein for each roll a separate drive train is used, each comprising a toothed coupling in combination with a further flexible coupling.

In a roll stand, the arrangement of two driving motors—a so-called twin drive—as a consequence of the large center-to-center distance of the motor drive shafts requires large angles of inclination of the drive spindles or, if these are to be avoided, drive spindles of corresponding length, which would, however, result in a torsionally flexible drive. This problem is encountered especially with four-high reversing stands, where the vertical adjustment travel of the upper work roll is considerable.

For arranging drive spindles having a larger angle of inclination it is known to provide cardan shafts comprising universal joints. Drive spindles having large angles of inclination are, however, associated with the disadvantage that at a predetermined diameter of the universal joints—which on account of the relatively small diameter of the work rolls cannot exceed a certain dimension—they can transmit only relatively small torques. The reason for this is that one is limited in the dimensioning of the cross pins of the universal joints; especially with greater angular positions, the cross pins call for great outside diameters of the universal joints.

From JP-A—60-37205 a roll stand is known in which each of the rolls is connected via a first toothed coupling with a first shaft and via a second toothed coupling with a connecting shaft and further via a universal joint with a flexible shaft and a further universal joint with a driving motor or a further flexible shaft. The connecting shafts are mounted in an adjustable guide and are arranged so as to be parallel with respect to each other. As a result, relatively large angles have to be absorbed by the toothed couplings, as a sufficiently great distance has to be created between the universal joints arranged on the connecting shafts. This considerably increases the wear of the toothed couplings. A further drawback of the known roll stand is to be seen in the fact that the distance between motor and roll stand is very great, resulting in a space-consuming drive arrangement. This also results in the transmission of momentum from the driving motors to the work rolls being too soft.

From JP-A—61-193711 a roll stand of the kind initially described is known which is of a design similar to the roll stand described in JP-A—60-37205. Each of the two rolls is via a toothed coupling connected with a first shaft and via a flexible coupling permitting greater angular deviations, such as a universal joint, with a flexible shaft and via a further such flexible coupling with a respective drive motor or gear. Thus each drive train is formed by two flexible shafts, which, as the flexible couplings for greater angular recesses require more space, results in a great distance between motor and roll stand, involving the disadvantage of the transmission of momentum from the drive motors to the work rolls being too soft. On account of the universal joints being disposed opposite to each other in accordance with the known roll stand, there result large angles of inclination of the flexible shafts with respect to each other, which have to be compensated for by the universal joints. This entrains increased signs of wear, so that the service life of the universal joints will not be very long. Further, the known construction involves extensive maintenance costs.

SUMMARY OF THE INVENTION

The invention aims at avoiding these disadvantages and difficulties and has as its object to provide a roll stand in which it is feasible even with rolls of small diameters and, if compared thereto, a relatively great center-to-center distance of the motor drive shafts to provide drive spindles which can be arranged at a large angle of inclination—and hence with a relatively short constructional length-, wherein it is still feasible to transmit very high driving moments, for instance for rolling high-strength rolling stock and for rolling at great reductions per pass.

In accordance with the invention this object is achieved in that one only of the drive spindles is formed by two components connected with each other by a flexible coupling permitting larger angular shaft displacements, one of said components being connected with the driving motor via such a flexible coupling, and the other drive spindle in the form of a single-component toothed spindle extends from the toothed coupling to a coupling arranged on the drive shaft of the motor and permitting angular shaft displacements, said coupling preferably also being a toothed coupling.

This construction is particularly space-saving and enables optimum dimensioning with respect to torque even with very narrow axial distances of the rolls.

To ensure adequate lubrication of the toothed couplings, it is advantageous if between the axes of the rolls and the axes of the components of the toothed couplings that are movable relative to the rolls, an angular position in the region between 0.5 and 1.5°, preferably an angular position of roughly 0.8°, is observed in each instance, wherein the dimensioning of the cardan shaft and also of the toothed spindles can be further improved if the axes of the toothed spindles diverge toward the driving motors.

Suitably, the toothed couplings carry crowned external toothings, wherein, in order to achieve axial movability of the driven rolls, the internal toothings of the toothed couplings extend in an axial direction over a multiple of the external toothing.

To constantly ensure the optimum pressure angle of the toothed coupling, i.e. the optimum angle between the axis of the roll and its associated toothed spindle, especially when changing the roll gap, the component of the toothed coupling of the toothed spindle connected with the cardan shaft which is movable relative to a roll is supported on the foundation via a compensating device serving to maintain a predetermined angular position, wherein the compensating device is formed by a parallel guide constructed as a system of levers.

In order to avoid excessive loads at right angles to the axial direction, the toothed spindles are supported relative to the foundation via pivot bearings by means of laterally guided spindle balancing means.

Other advantages and objects of the present invention will be readily apparent from the following description of a preferred embodiment, the drawings and claims.

DESCRIPTION OF THE PREFERRED EMBODIMENT

Figure 1:
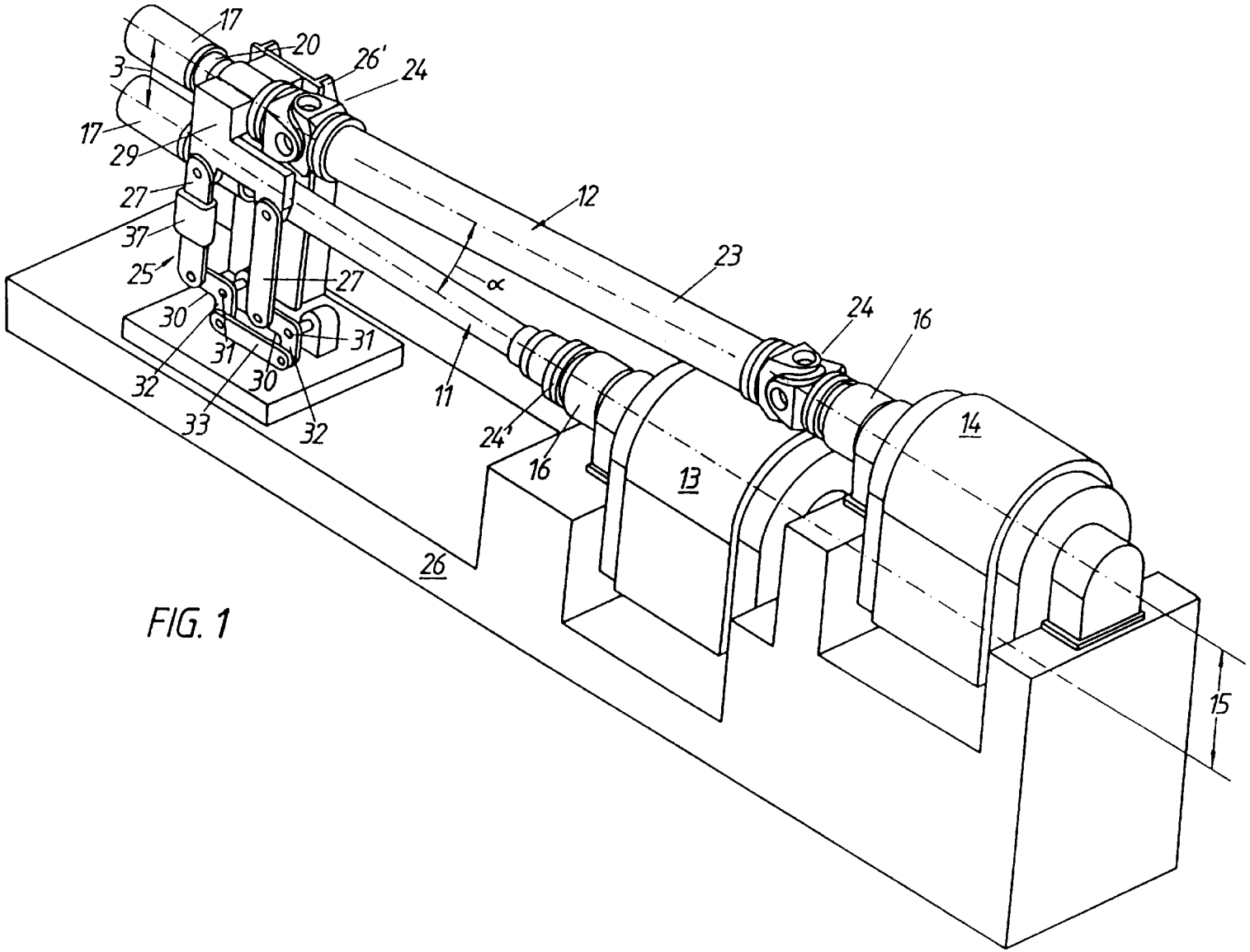
FIG. 1 is a perspective view of the drive motor and drive trains for a roll stand in accordance with the present invention.

Two work rolls 1, 2 of a four-high plate stand, whose axial distance 3 is adjustable to the desired plate thickness, in accordance with FIG. 1 are supported on the roll stand 7 by their driving pins 4, 5 via bearings generally denoted at 6. To avoid deflection of the work rolls 1, 2, back-up rolls 8 are provided which are also rotatably mounted on the roll stand 7 via bearings 9.

The work rolls 1, 2 having only a relatively small diameter 10 can each be driven via a separate drive spindle 11, 12 by means of a separate driving motor 13, 14. The arrangement of the driving motors 13, 14 is chosen such that the axial distance 15 of the drive shafts 16 of the driving motors 13, 14 is as small as possible. To avoid having to construct the drive spindles 11, 12 to be very long, which would result in the transmission of momentum from the driving motors 13, 14 to the work rolls 1, 2 being too soft, the drive spindles 11, 12 are arranged so as to be inclined towards each other.

Figure 2:
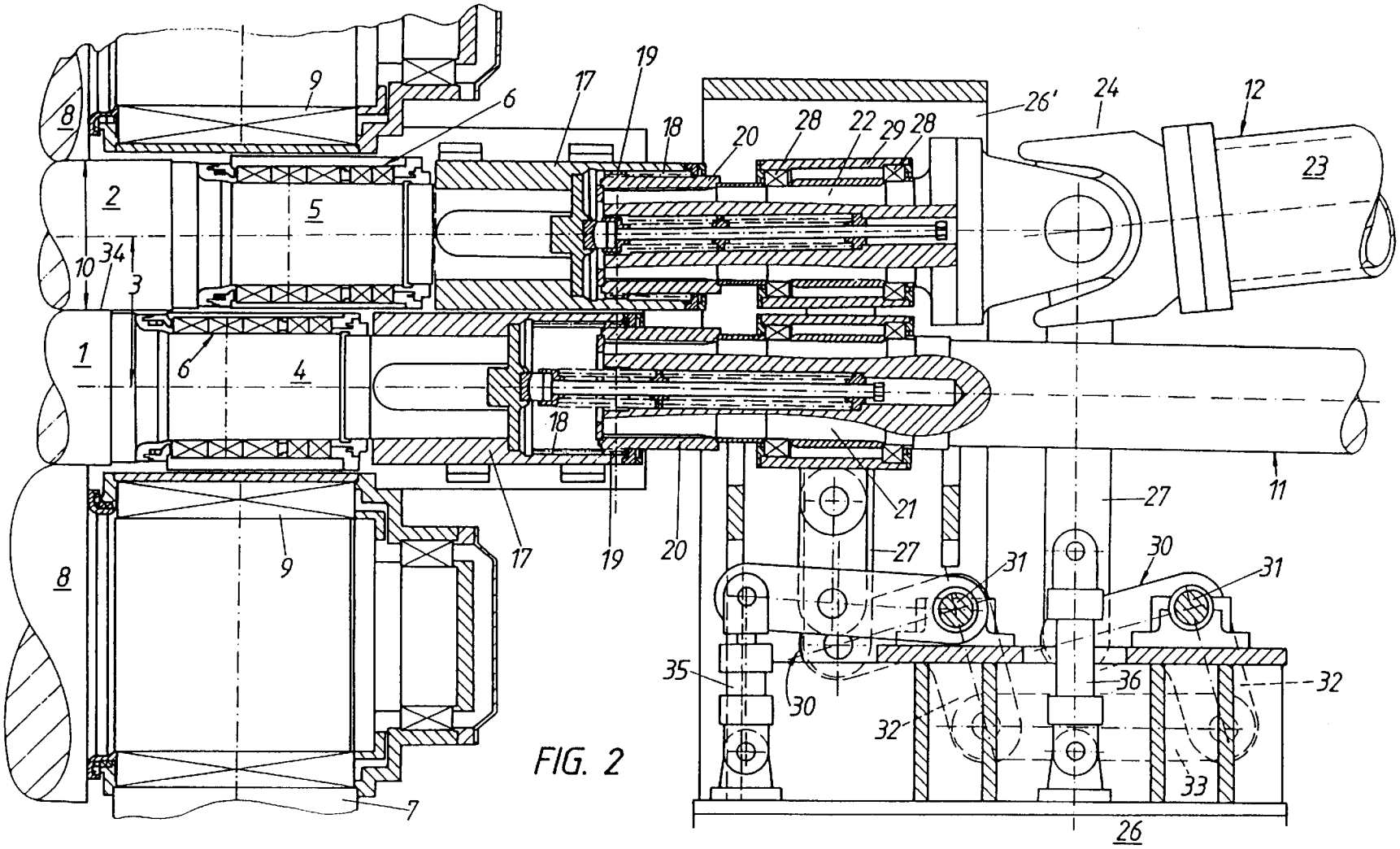
FIG. 2 is a cross sectional view taken along the axes of the drive spindles of FIG. 1.

In accordance with the invention, each driving pin 4, 5 of the work rolls 1, 2 is connected with a sleeve 17 carrying an internal toothing 18 in such a way as to be secured against twisting. This internal toothing 18 is engaged by a crowned external toothing 19 arranged externally on a further sleeve 20. Thus, each of the sleeves 17 and 20 forms a toothed coupling. The length of the internal toothing 18 exceeds that of the teeth of the external toothing 19 by a multiple, thus enabling axial mobility. The work rolls 1, 2 can therefore be displaced in axial direction with respect to the roll stand 7. Different axial positions of the work rolls 1, 2 are illustrated in FIG. 2.

Each of the sleeves 20 provided with the external toothing 19 is mounted on a spindle 21 or 22 respectively in such a way as to be secured against twisting and together with this spindle 21 or 22 respectively forms a so-called toothed spindle.

In accordance with the illustrated exemplary embodiment, the drive spindle 12 of the upper work roll 2 is formed by the toothed spindle 20, 22 and by a cardan shaft 23 connected thereto, which via its universal joints 24 is on the one hand connected with the toothed spindle 20, 22 and on the other hand with the drive shaft 16 of the upper driving motor 14. Instead of the universal joints 24 it would also be feasible to provide other flexible couplings adapted to transmit higher torques, for instance flat pin couplings.

The drive spindle 11 of the lower work roll 1 up to the drive shaft 16 of the lower driving motor 13 is constructed to be rigid—though optionally comprising several parts—and is coupled with the drive shaft 16 of the lower driving motor 13 via a toothed coupling 24'. The axial positions of the toothed spindles 20, 21 and 20, 22 have been chosen such that their axes enclose an angle of between 0.5 and 1.5°, preferably an angle of roughly 0.8°, with the axes of the associated work rolls 1, 2. For the lower work roll 1, which is arranged in the roll stand 7 in such a manner as to be only slightly adjustable, this is accomplished by a suitable arrangement of the lower driving motor 13; for the upper work roll 2, in order to keep to the optimum angular range, the toothed spindle 20, 22 has to be supported relative to the foundation 26 by means of a compensating device constructed as a parallel guide 25. The parallel guide 25 is formed by a system of articulated levers, namely in that roughly vertically oriented brackets 27 engage at a housing 29 surrounding the upper toothed spindle 20, 22 and supported with respect to the toothed spindle 20, 22 by means of pivot bearings 28, said housing 29 being secured against twisting with respect to the foundation 26. Each of the brackets 27 is pivoted to an angle lever 30 whose toggle joint 31 is rotatably supported on the foundation 26. The further lever arms 32 of the angle levers 30 are connected via a bracket 33 compensating the tension or compression respectively. Hereby, it is feasible for the toothed spindle 20, 22 of the upper work roll 2 to be adjusted together with the same in a vertical direction parallel with respect to itself, for instance in order to adjust roll gaps 34 of different heights.

To avoid loads caused by the weight of the drive spindles 11, 12, the toothed spindles 20, 21 and 20, 22 are supported with respect to the foundation 26 by means of spindle balancing means 35, 36, only shown in FIG. 2, which are supported by a lateral guide 26'.

As can be seen particularly well from FIG. 2, one succeeds in dimensioning the universal joints 24 of the cardan shaft 23 to be very big in spite of very small diameters 10 of the work rolls 1, 2, by constructing the roll stand in accordance with the invention, namely due to the provision of the toothed couplings 17, 20 and the toothed spindles 20, 21 and 20, 22.

Here, the arrangement of the toothed spindles 20, 21 and 20, 22 is chosen such that they diverge toward the driving motors 13, 14, whereby it becomes feasible to construct the universal joint 24 connecting the cardan shaft 23 with the toothed spindle 20, 22 on a maximum scale. This is of importance inasmuch as the moment to be transmitted increases by the third power of the diameter of the universal joints 24 or the cardan shaft 23 respectively. It is thus feasible, in spite of the small diameters 10 of the work rolls 1, 2 and the fact that the driving motors 13, 14 are arranged in relatively close vicinity to the roll stand 7, to transmit a very high torque, namely one which is considerably higher than is feasible with the prior art, and, as an added advantage, a torsion-proof drive is also realized in the process.

A further advantage is to be seen in that due to the arrangement of the toothed couplings 17, 20 only a very slight displacing force is required in order to displace the work rolls 1, 2. This displacing force is considerably lower than that required, for instance, in order to displace a work roll driven by means of a conventional universal shaft with length compensation.

A further advantage results from incorporating a spring-and-damper element constructed as an encased spring 37 into the system of levers of the parallel guide 25. Hereby, forces acting dynamically on the neck of the roll as bending forces, caused by the vertical accelerations of the drive train at the entry or exit of the rolling material, are reduced to a fraction of conventional values. The encased spring 37 can be provided at any lever of the system of levers. Preferably, the spring-and-damper element is adjustable in dependence on the force.

I claim:

1. A roll stand comprising two rolls with axes forming a roll gap, which rolls are driven by their separate drive motors via drive spindles, with each roll having a separate drive train comprising a toothed coupling, the improvements comprising a first drive train of the separate drive trains being formed by a drive spindle with first and second components connected with each other by a flexible coupling permitting large angular shaft displacements and the first component being connected with the drive shaft of the drive motor by a second flexible coupling and a second drive train of the separate drive trains having a drive spindle in the form of a single component toothed spindle extending from the toothed coupling to a second coupling arranged on the drive shaft of the motor and said second coupling being a toothed coupling permitting angular displacement, the second component of the first drive train being substantially shorter than the single component, and the axes of the first and second components diverging away from the axis of the single component.

2. A roll stand according to claim 1, wherein the components of each toothed coupling have axes movable relative to the axes of the rolls through an angular position in a range of between 0.5° and 1.5°.

3. A roll stand according to one of claims 1 or 2, wherein each toothed coupling has internal teeth and external teeth, the internal teeth of each toothed coupling having an axial length which is a multiple of the axial length of the external teeth of each toothed coupling.

4. A roll stand according to one of claims 1 or 2, wherein the component of the toothed coupling of the toothed spindle of the first drive train is supported on a foundation by a compensation device serving to maintain a predetermined angular position, which compensation device is formed by a parallel guide constructed as a system of levers.

5. A roll stand according to one of claims 1 or 2, wherein the toothed spindles are supported relative to a foundation via a pivot bearing by means of a lateral guide spindle balancing means.

6. A roll stand according to claim 1, wherein the roll stand is a four-high stand.

7. A roll stand according to claim 2, wherein the angular position is roughly 0.8°.

8. A roll stand according to claim 4, wherein the toothed spindles are supported relative to the foundation via a pivot bearing by means of a lateral guide spindle balancing means.

9. A roll stand according to claim 8, wherein a spring-and-damper element is provided in the system of levers of the parallel guide and is adjustable in dependence of the force applied.

10. A roll stand comprising two rolls with axes forming a roll gap, which rolls are driven by their separate drive motors via drive spindles, with each roll having a separate drive train comprising a toothed coupling, the improvements comprising a first drive train of the separate drive trains being formed by a drive spindle with two components connected with each other by a flexible coupling permitting large angular shaft displacements and one of said two components being connected with the drive shaft of the drive motor by a second flexible coupling and a second drive train of the separate drive trains having a drive spindle in the form of a single component toothed spindle extending from the toothed coupling to a second coupling arranged on the drive shaft of the motor and said second coupling being a toothed coupling permitting angular displacement, the component of the toothed coupling of the toothed spindle of the first drive train being supported on a foundation by a compensation device serving to maintain a predetermined angular position, which compensation device is formed by a parallel guide constructed as a system of levers.

11. A roll stand according to claim 10, wherein the toothed spindles are supported relative to the foundation via a pivot bearing by means of a lateral guide spindle balancing means.

12. A roll stand according to claim 11, wherein a spring-and-damper element is provided in the system of levers of the parallel guide and is adjustable in dependence of the force applied.

13. A roll stand comprising two rolls with axes forming a roll gap, which rolls are driven by their separate drive motors via drive spindles, with each roll having a separate drive train comprising a toothed coupling, the improvements comprising a first drive train of the separate drive trains being formed by a drive spindle with two components connected with each other by a flexible coupling permitting large angular shaft displacements and one of said two components being connected with the drive shaft of the drive motor by a second flexible coupling and a second drive train of the separate drive trains having a drive spindle in the form of a single component toothed spindle extending from the toothed coupling to a second coupling arranged on the drive shaft of the motor and said second coupling being a toothed coupling permitting angular displacement, the toothed spindles being supported relative to a foundation via a pivot bearing by means of a lateral guide spindle balancing means.

* * * * *